US005460537A

United States Patent [19]

Noschese

[11] Patent Number: 5,460,537

[45] Date of Patent: Oct. 24, 1995

[54] PRINTED CIRCUIT BOARD STABILIZER FOR A CARD EDGE CONNECTOR

[75] Inventor: Rocco J. Noschese, Wilton, Conn.

[73] Assignee: Burndy Corporation, Norwalk, Conn.

[21] Appl. No.: 165,367

[22] Filed: Dec. 10, 1993

[51] Int. Cl.[6] ..... H01R 13/62

[52] U.S. Cl. ..... 439/325; 439/326

[58] Field of Search ..... 439/59, 60, 325, 439/376, 630–637

[56] References Cited

U.S. PATENT DOCUMENTS

| | | | |
|---|---|---|---|
| 3,289,148 | 11/1966 | Antes | 339/176 |
| 3,399,372 | 8/1968 | Uberbacher | 339/17 |
| 4,118,094 | 10/1978 | Key | 439/635 |
| 4,477,138 | 10/1984 | Andrews, Jr. et al. | 439/325 |
| 4,695,108 | 9/1987 | Ichitsubo | 439/59 |
| 4,712,848 | 12/1987 | Edgley | 439/327 |
| 4,747,790 | 5/1988 | Masuda et al. | 439/631 |
| 4,756,694 | 7/1988 | Billman et al. | 439/61 |
| 4,776,805 | 10/1988 | Brown et al. | 439/637 |
| 4,891,023 | 1/1990 | Lopata | 439/637 |
| 4,904,197 | 2/1990 | Carbourne | 439/635 |
| 4,941,830 | 7/1990 | Tkazyik et al. | 439/59 |
| 4,990,107 | 2/1991 | Fortuna | 439/637 |
| 5,041,005 | 8/1991 | McHugh | 439/326 |
| 5,066,241 | 11/1991 | Halls | 439/635 |
| 5,096,435 | 3/1992 | Noschese et al. | 439/260 |
| 5,106,311 | 4/1992 | Yodogawa et al. | 439/77 |
| 5,203,725 | 4/1993 | Brunker et al. | 439/636 |
| 5,207,598 | 5/1993 | Yamada et al. | 439/636 |

*Primary Examiner*—Larry I. Schwartz
*Assistant Examiner*—Hien D. Vu
*Attorney, Agent, or Firm*—Perman & Green

[57] ABSTRACT

A card edge connector is provided with a housing, electrical contacts, and movable wedge clips. The wedge clips are slidingly mounted to the housing at an angle to a card edge receiving slot in the housing. The, wedge clips are suitably shaped and mounted to the housing to be contacted by and moved with a printed circuit board inserted into the receiving slot. The wedge clips include a spring section for returning the clips to a home position when the board is removed from the receiving slot.

13 Claims, 2 Drawing Sheets

FIG. 2
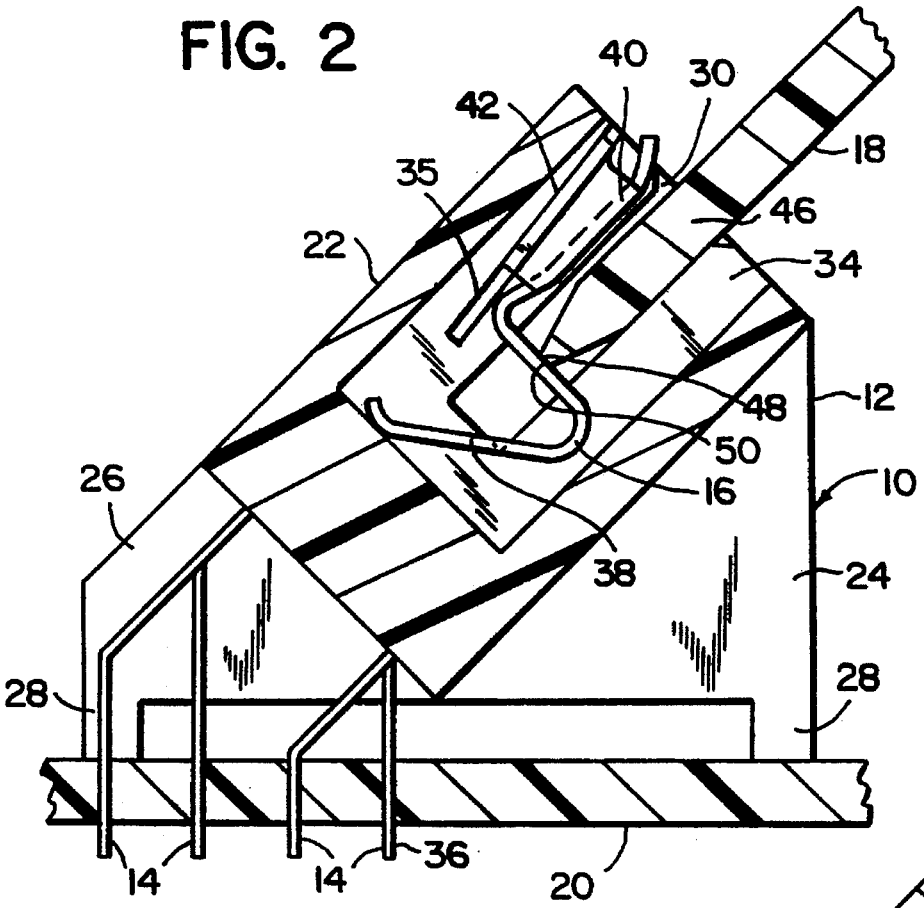
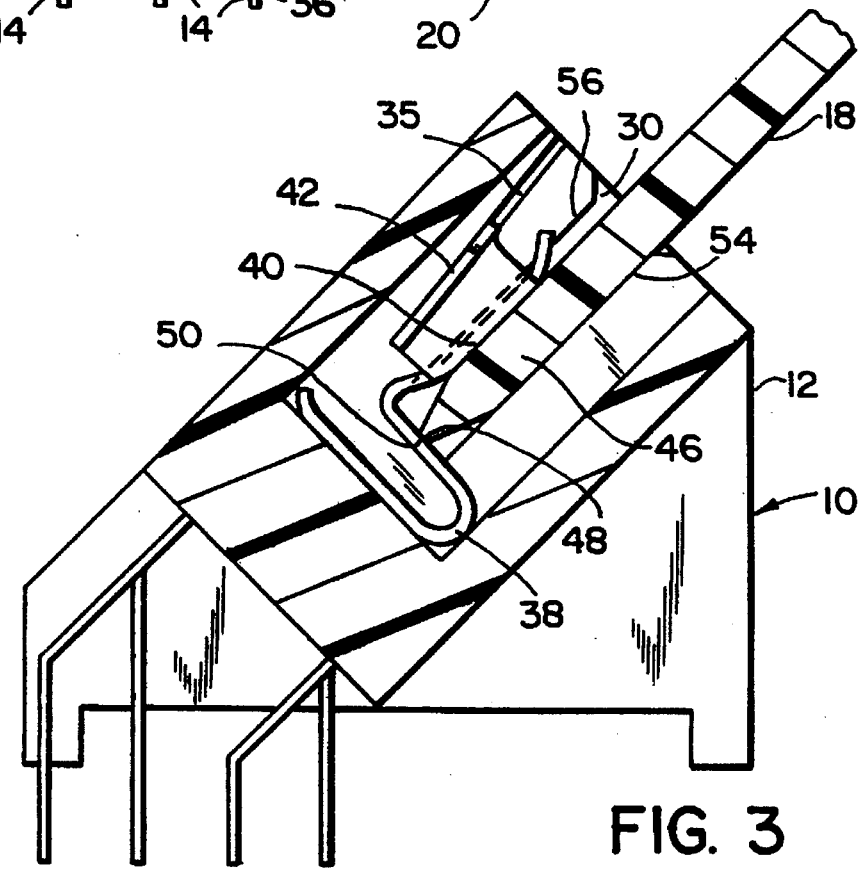
FIG. 3

PRINTED CIRCUIT BOARD STABILIZER FOR A CARD EDGE CONNECTOR

BACKGROUND OF THE INVENTION

1. Field of the Invention

The present invention relates to electrical connectors and, more particularly, to a stabilizing system for stabilizing a printed circuit board in a receiving slot of a card edge connector.

2. Prior Art

U.S. Pat. No. 3,399,372 discloses an adjusting system for very close tolerances in a card edge connector. U.S. Pat. No. 5,106,311 discloses a connector for a flexible cable with a slider fitted into the housing to wedge the flexible cable into contact with electrical contacts. U.S. Pat. No. 5,203,725 discloses various types of biased card edge connectors. U.S. Pat. No. 5,096,435 discloses a card edge connector with a cover that is moved down by a printed circuit board. U.S. Pat. 4,756,694 discloses an angled card edge connector.

SUMMARY OF THE INVENTION

In accordance with one embodiment of the present invention, an electrical connector is provided comprising a housing, a plurality of electrical contacts mounted to the housing, and a wedge. The housing has a card edge receiving area. The wedge is for locating an edge of a printed circuit board in a predetermined position in the card edge receiving area. The wedge is movably mounted to the housing with a first portion located in the card edge receiving area for being contacted by and moved with the printed circuit board as the board is inserted into the card edge receiving area.

In accordance with another embodiment of the present invention, an electrical connector is provided comprising a housing, a plurality of electrical contacts mounted to the housing, and wedge clips. The housing has a card edge receiving slot. The wedge clips are longitudinally slidingly mounted to the housing. The wedge clips have a spring section and a forward contact section.

In accordance with another embodiment of the present invention, an angled card edge connector is provided comprising a housing, a plurality of electrical contacts connected to the housing, and means for locating a card edge connection area of a printed circuit board. The housing has a first side for connection to a first printed circuit board and a card edge receiving slot located at an angle to the first side of less than 90°. The electrical contacts have tail ends extending from the first side of the housing. The means for locating can locate the card edge connection area of a second printed circuit board in the card edge receiving slot at a predetermined position. The means for locating comprises a wedge slidingly connected to the housing for pushing the card edge connection area against a side of the card edge receiving slot.

BRIEF DESCRIPTION OF THE DRAWINGS

The foregoing aspects and other features of the invention are explained in the following description, taken in connection with the accompanying drawings, wherein:

FIG. 2 is a cross-sectional view of the connector shown in FIG. 1 as the daughter board is being initially inserted; and FIG. 3 is a cross-sectional view of the connector shown in FIG. 2 with the daughter board fully inserted into the connector.

DETAILED DESCRIPTION OF THE INVENTION

Figure 1:
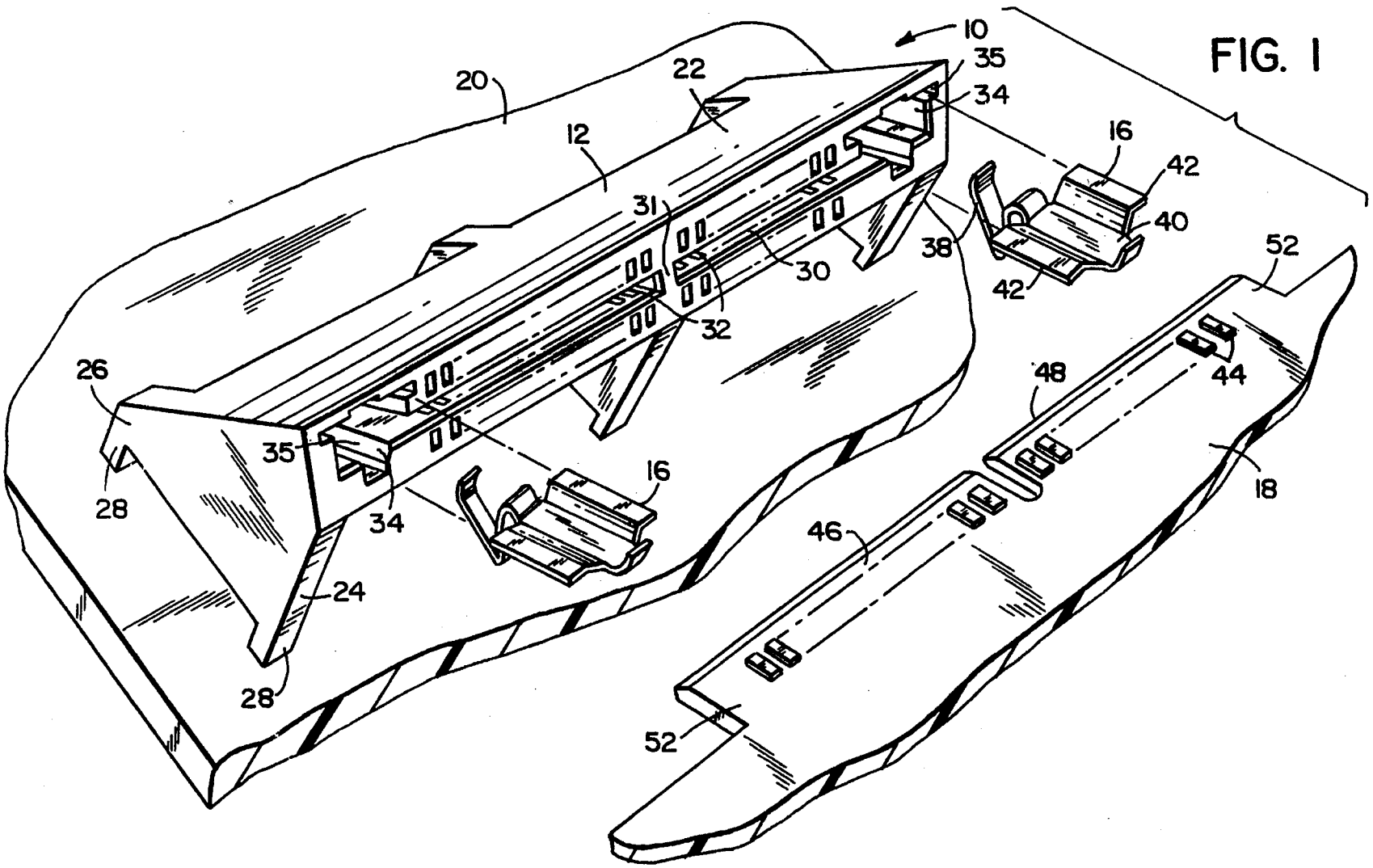
FIG. 1 is a perspective view of a card edge connector attached to a mother printed circuit board, with an exploded view of the connector's wedge clips, and a daughter printed circuit board.

Referring to FIG. 1, there is shown a card edge connector 10 incorporating features of the present invention. Although the present invention will be described with reference to the single embodiment shown in the drawings, it should be understood that the present invention can be embodied in various different forms of alternate embodiments. In addition, any suitable size, shape or type of elements or materials could be used.

The connector 10 generally comprises a housing 12, electrical contacts 14 (see FIGS. 2 and 3), and wedge clips 16. The connector 10 is used to removably connect a daughter printed circuit board 18 to a mother printed circuit board 20. The housing 12, in the embodiment shown, is comprised of a dielectric material, such as a molded polymer or plastic material. Referring also to FIG. 2, the housing 12 includes a main section 22 and, front and rear support sections 24,26. The support sections 24,26 have standoffs 28 at their bottoms that are positioned against the mother board 20. The main section 22 has a card edge receiving area or slot 30, a plurality of contact receiving channels 32 located on opposite sides of the area 30, and wedge clip slots 34 located at opposite ends of the card edge receiving area 30. The wedge clip slots 34 intersect the card edge receiving area 30 and include wing channels or wing slots 35 at an upper area of the wedge clip slots 34. In the embodiment shown, the receiving slot 30 actually comprises two slots separated by a polarization wall 31 as is known in the card edge connector technology.

It should be understood that, as used herein, the terms card edge receiving slot or card edge receiving area are intended to include multiple slots or areas separated by walls such as polarization wall 31. The connector 10 is an angled card edge connector; i.e.: not a purely perpendicular card edge connector nor a purely parallel card edge connector. The housing 12 is constructed such that, when properly mounted on the mother board 20, the card edge receiving slot 30 is angled relative to the plane of the mother board at an angle preferably between about 30° and 60°. Therefore, when the daughter board 18 is properly connected to the connector 10, the daughter board 18 is angled relative to the plane of the mother board at an angle of between about 30° and 60°. In alternate embodiments, the housing can be suitably constructed to provide an angle greater than or less than the 30° and 60° angles described above. In an preferred embodiment, the angle is 45°. Features of the present invention can also be used in parallel and perpendicular card edge connectors.

The electrical contacts 14 are comprised of electrically conductive material. Each contact has a tail end 36, a middle section fixedly connected to the housing main section 22 in one of the contact receiving channels 32, and a top contact spring arm that extends through the receiving channel 32 into the card edge receiving slot 30. Such contacts are well known in the connector area. In the embodiment shown, the tail ends 36 are through-hole mounted to the mother board 20. However, in an alternate embodiment, the tail ends could be surface mounted.

The wedge clips 16 generally comprise a spring section 38, a board contact section 40, and two wing sections 42. The wing sections 42 extend from opposite sides of the board contact section 40 at an offset. The spring section 38 extends from a bottom end of the board contact section 40 and has a general leaf spring design. The wing sections 42 are slidingly located in the wing slots 35.

Referring now particularly to FIGS. 2 and 3, the purpose of the wedge clips 16 is to combine with the housing 12 to support the weight of the daughter board 18. This is to assure stable contact by the spring contacts 14 with the contact pads 44 on the daughter board 18 (see FIG. 1). As is known in the printed circuit board technology, daughter boards can have contact pads 44 on both sides of the card edge or card edge connection area 46 (see FIG. 1) that is inserted into the card edge receiving area 30. Because the card edge receiving area 30 has to be wider than the width of the card edge connection area 46 to allow easy insertion and removal and, because of the angled nature of the daughter board 18 when connected to the connector 10, the weight of the daughter board outside of the card edge receiving area 30 would otherwise cause the card edge connection area 46 to be angled or canted relative to the card edge receiving area 30. This is undesirable because such a cant of the area 46 in the area 30 could result in inadequate contact between the spring contacts 14 and some of the daughter board contact pads 44. Therefore, the present invention uses the wedge clips 16 to force the connection area 46 into a predetermined position in the receiving area 30. Because the connector designers know precisely where the connection area 46 will be located in the receiving area 30, they can configure the spring arms of the spring contacts 14 to insure proper contact with the contact pads 44.

As seen in FIG. 2, when the daughter board 18 is initially inserted into the receiving area 30, its leading edge 48 contacts the wedge clips 16 at areas 50 of the spring sections 38. In the home position of the wedge clips 16 shown in FIG. 2, the areas 50 of the wedge clips 16 are located in the intersections of the wedge clip slots 34 and card edge receiving area 30. Also in the home position shown, the board contact sections 40 are not located in the card edge receiving area 30. The wing sections 42 are slidingly located in the wing slots 35. The bottoms of the spring sections 38 are located against the bottoms of the wedge clip slots 34. This keeps the wedge clips 16 at their home positions until the daughter board 18 is further inserted.

As the daughter board 18 is further inserted to the position shown in FIG. 3, the leading edge 48 of the daughter board 18 pushes the areas 50 down. This causes the spring sections 38 to be compressed. It also causes the board contact sections 40 and wing sections 42 to move deeper into the wedge clip slots 34. The wing slots 35 are angled relative to the card edge receiving slot 30. Therefore, as the wing sections 42 move deeper into the wedge clip slots 34, the wing sections 42 are moved towards the card edge receiving slot 30. This causes the board contact sections 40 to also move towards the card edge receiving slot 30 and, actually moves into the intersections. As the board contact sections 40 moves into the intersection between the slots 30,34, they contacts the ends 52 (see FIG. 1) of the card edge connection area 46 on the daughter board 18 and push the connection area 46 against an interior side wall 54 in the card edge receiving slot 30. This insures that the card edge connection area 46 will not be canted in the receiving slot 30 when fully inserted. Because the connection area 46 is positioned into a predetermined position in the receiving slot 30, the contacts 14 can be designed to insure good electrical connection with the contact pads 44 at this predetermined position. The spring sections 38 are sufficiently weak so as not to push the daughter board 18 out of the receiving slot 30. However, when the daughter board 18 is intentionally removed from the connector 10, the spring sections 38 are able to return the wedge clips 16 back to their home positions.

In alternate embodiments, other types, shapes, sizes and numbers of wedge clips or similarly functioning wedges could be used. In addition, rather than wedging the connection area 46 against the bottom interior wall 54, it could be wedged against the top interior wall 56, or between wedges on opposite sides of the connection area 46. A separate spring could also be used rather than an integral spring section on the wedge clip 16. Other types of means to provide movement of the wedge clips when the daughter board 18 is inserted into the connector 10 could also be provided.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a housing having a card edge receiving area;

a plurality of electrical contacts mounted to the housing; and a wedge for locating an edge of a printed circuit board in a predetermined position in the card edge receiving area, the wedge being movably mounted to the housing with a first portion located in the card edge receiving area for being contacted by and moved with the printed circuit board as the board is inserted into the card edge receiving area wherein the first portion includes a flexible spring section adapted to be compressed by the printed circuit board as the board is inserted into the card edge receiving area and the wedge includes a second portion for contacting the printed circuit board and pushing the printed circuit board against an elongate longitudinal side of the card edge receiving area when the printed circuit board is fully inserted in said card edge receiving area.

2. A connector as in claim 1 wherein the wedge includes a third portion slidingly mounted in a slot of the housing, the slot being located at an angle relative to the card edge receiving area.

3. A connector as in claim 1 wherein the connector has two of the wedges; one at each end of the card edge receiving area.

4. A connector as in claim 1 wherein the card edge receiving area is a slot angled relative to a first side of the housing at an angle of between about 30° to about 60°.

5. An electrical connector comprising:

a housing having a card edge receiving slot;

a plurality of electrical contacts mounted to the housing; and wedge clips longitudinally slidingly mounted to the housing, the wedge clips having a spring section and a board contact section wherein the wedge clips each include two wing sections extending from and offset from the board contact section wherein the wedge clips are suitably shaped and mounted to the housing to be contacted by and then moved with a printed circuit board inserted into the card edge receiving slot.

6. A connector as in claim 5 wherein the wedge clips are mounted in a channel of the housing, the channel being located at an angle to the card edge receiving slot.

7. A connector as in claim 5 wherein the spring section is located, at least partially, in the card edge receiving slot such that a printed circuit board can contact the spring section as the board is inserted into the slot.

8. A connector as in claim 5 wherein the wedge clips are suitably shaped and mounted to the housing to push a card edge connection area of a printed circuit board against a side of the card edge receiving slot as the connection area is inserted into the receiving slot.

9. A connector as in claim 5 wherein the card edge receiving slot has a wedge clip at each end, and the housing has a polarizing section located in the slot.

10. An angled card edge connector comprising:

a housing having a first side for connection to a first printed circuit board and a card edge receiving slot located at an angle to the first side of less than 90°;

a plurality of electrical contacts connected to the housing, the contacts having tail ends extending from the housing; and means for locating a card edge connection area of a second printed circuit board in the card edge receiving slot at a predetermined position, the means for locating comprising a wedge slidably connected to the housing for pushing the card edge connection area towards a side of the card edge receiving slot when the printed circuit board is fully inserted in said card edge receiving slot, wherein the wedge is suitably shaped and connected to the housing to be contacted by and moved with the second printed circuit board, at least partially, as the second board is inserted into the receiving slot.

11. A connector as in claim 10 wherein the wedge is slidingly connected to the housing at an angle to the card edge receiving slot.

12. A connector as in claim 10 wherein the wedge includes a spring section adapted to return the wedge to a home position when the card edge connection area is removed from the receiving slot.

13. A connector as in claim 10 wherein the means for locating includes two wedges, one at each end of the receiving slot.

* * * * *